US005351899A

United States Patent [19]

Koenig

[11] Patent Number: 5,351,899

[45] Date of Patent: Oct. 4, 1994

[54] MODULAR AUGER SHREDDER SYSTEM

[76] Inventor: Larry E. Koenig, c/o Komar Industries, Inc., 4425 Marketing Pl., Groveport, Ohio 43125

[21] Appl. No.: 16,805

[22] Filed: Feb. 11, 1993

[51] Int. Cl.[5] ..... B02C 18/22

[52] U.S. Cl. ..... 241/260.1; 241/285.1; 241/285.2

[58] Field of Search ..... 241/260.1, 285.1, 285.2, 241/222, 235, 242, 248, 224

[56] References Cited

U.S. PATENT DOCUMENTS 4,101,083 7/1978 Faist ..... 241/285.1

4,938,426 7/1990 Koenig ..... 241/285.2 X

*Primary Examiner*—Douglas D. Watts

*Attorney, Agent, or Firm*—Thompson, Hine and Flory

[57] ABSTRACT

A modular auger shredder system which includes a plurality of shredder modules arranged in side-by-side relation to form an array of modules which act in concert to process waste material. In a preferred embodiment, the array is mounted on a transverse conveyor, such as a screw conveyor, which transports materials which has passed through the array and has been shredded. Each module includes a housing which defines a grinding chamber, a pair of opposed, counter-rotating auger screws for shredding material within the grinding chamber, end enclosures housing hydraulic motors for driving the screws and side defectors which are shaped to follow the outer contours of the auger screws and guide material into the screws.

16 Claims, 5 Drawing Sheets

MODULAR AUGER SHREDDER SYSTEM

BACKGROUND OF THE INVENTION

The present invention relates to grinding and shredding systems and, more particularly, to grinding and shredding systems which include a rotary auger screw.

A typical shredding device is shown in Koenig U.S. Pat. No. 4,993,649 and includes a housing having a front wall, a rear bulkhead which is part of a motor enclosure, side walls and an open top which acts as an infeed hopper. The bottom of the housing includes a floor which is partially conical in shape and which includes a pair of sliding doors that are positionable between fully-opened and fully-closed positions. A pair of opposing, tapered auger screws are mounted rotatably within the housing and are driven by hydraulic motors enclosed within the equipment enclosure.

The screws are oppositely oriented and have axes of rotation oriented substantially horizontally and parallel to each other. The screws are driven to counter-rotate within the housing and interact to crush, grind and shred material. The size reduction effected by the auger screws is enhanced by providing the screws with teeth which project radially from the outer peripheries of the screw flights, and stationary breaker bars mounted on the conical portions of the floor. The meshing of the teeth and breaker bars provides a shearing action which further reduces particle size.

The maximum hopper opening size of such a dual auger machine is limited by the size of the auger screws within the housing. With each geometry of auger screw, there is an optimal spacing between screw flights. If such spacing is exceeded, the cooperation of the screws to reduce particle size is reduced.

However, there is a need for providing a large scale device or system which is capable of receiving, holding and processing large volumes of waste material at relatively rapid rates. It is not practical to provide a plurality of discrete dual auger units such as that disclosed in the Koenig U.S. Pat. No. 4,993,649. Accordingly, there is a need for a unitary system which has a relatively high throughput capacity, yet is efficient in reducing particle size.

SUMMARY OF THE INVENTION

The present invention is a modular auger shredder system which comprises a plurality of shredder modules arranged in side-by-side relation and attached to each other to form an array which acts in unison to process extremely large volumes of waste material rapidly and efficiently. Each module includes a housing having an open top and bottom for throughput of material to be shredded, opposing end enclosures for housing drive motors, a pair of substantially horizontally-oriented, opposed tapered auger screws and conical side deflectors extending between the end housings for guiding material into contact with the auger screws and for providing a support surface which interacts with the advancing auger screw threads.

The modules are shaped such that spacing between auger screws of adjacent modules is substantially equal to the spacing between auger screws within a module. To allow variations in spacing would reduce the efficiency of the array of modules in rapidly reducing particle size. In the preferred embodiment, the auger screws within a module are opposed and have tapering flights. The screws are spaced such that the outer peripheries of the screw threads at the bases of the screws overlap when viewed in a horizontal plane containing the screws. Accordingly, in order to maintain such overlapping arrangement between screws of adjacent modules, it is necessary to form the modules to have a rhomboid shape when seen in plane view. The rhomboid shape conforms to the taper of the screw threads and permits overlapping spacing between screws of adjacent modules.

Also in the preferred embodiment, the array of modules of the preferred embodiment includes modular extensions mounted on the ends of the modules forming an input hopper, end walls, attached to the outboard faces of end modules of an array, and a transverse conveyor, positioned below the open bottoms of the modules, to receive shredded material and convey it to a collection point.

Accordingly, it is an object of the present invention to provide a modular auger shredder system which is built up from a selected number of identical shredder modules; an auger shredder system comprising a plurality of shredder modules, each having a pair of opposed, overlapping tapered screws and in which the overlapping relationship is maintained continuously across an array of such modules; a modular auger shredder system which has high capacity and in which individual modules can be shipped using conventional transportation means; and a modular auger shredder system which is rugged, relatively easy to fabricate, and relatively inexpensive to maintain.

Other objects and advantages will be apparent from the following description, the accompanying drawing and appended claims.

DETAILED DESCRIPTION

Figure 1:
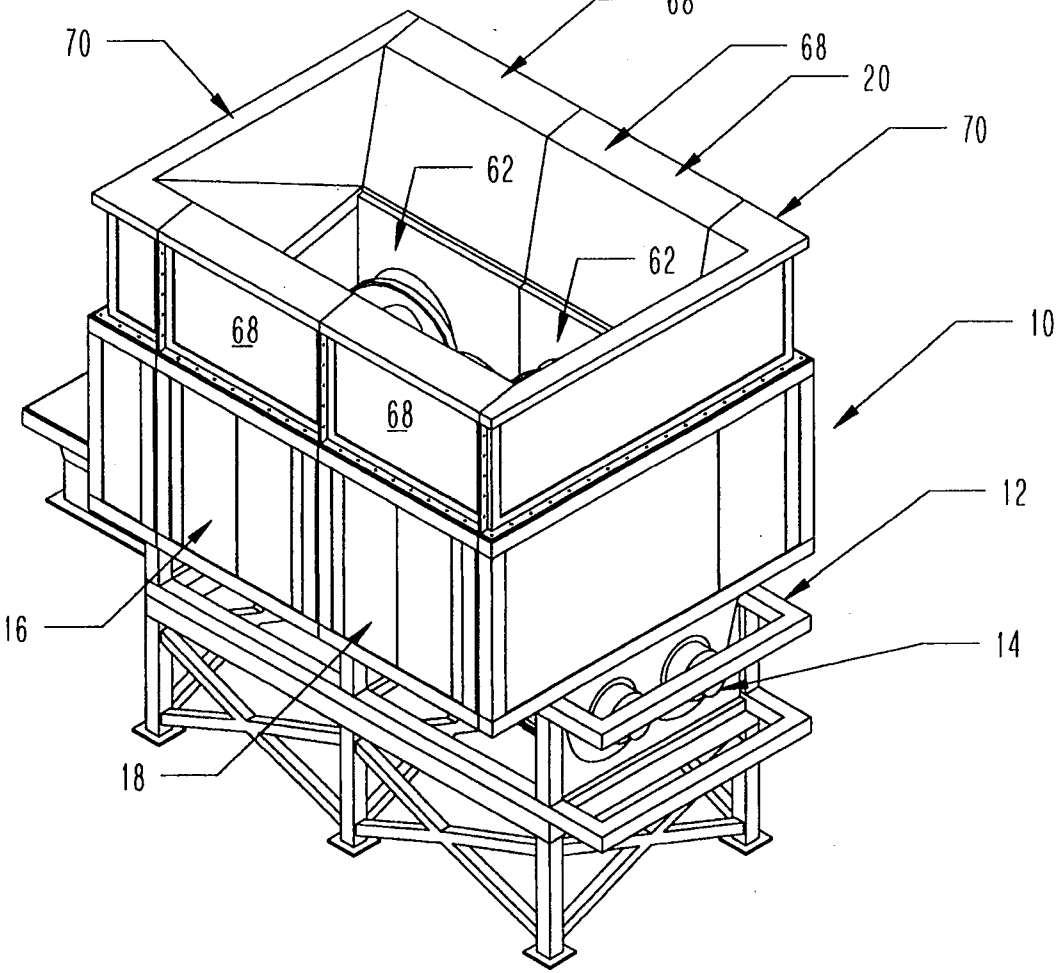
FIG. 1 is a perspective view of a preferred embodiment of the modular auger shredder system of the present invention.

As shown in FIG. 1, the modular auger shredder system of the present invention, generally designated 10, is mounted on a support structure, generally designated 12, which includes a transverse conveyor 14. The system 10 includes modules 16, 18 positioned in side-by-side relation and are identical to each other. The modules 16, 18 are bolted together and combine to form a unitary array for processing waste material. The tops of the modules 16, 18 are open and are surrounded by a hopper 20 for guiding material to the modules.

Figure 2:
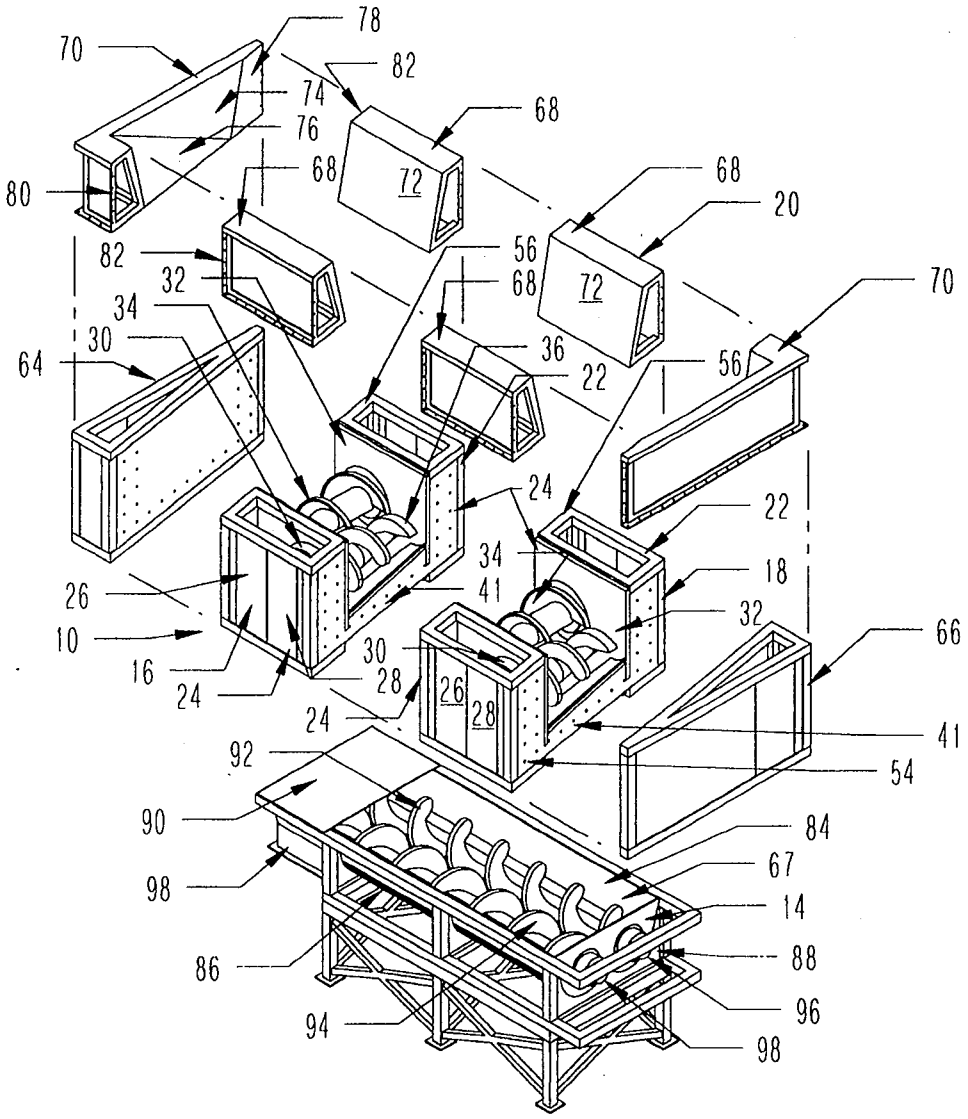
FIG. 2 is an exploded, perspective view of the system shown in FIG. 1.

As shown in FIG. 2, each of the modules 16, 18 includes a housing 22 having end enclosures 24 which include access doors 26, 28 and house equipment, such as hydraulic drive motors 30, for controlling the action of the rotating components of the system. Each end enclosure 22 includes a bulkhead 32 on which is mounted an auger screw assembly 34. As shown best in FIG. 4, each auger screw assembly 34 includes two auger screws 36, each having a tapered flight 38. The screws 36 are positioned on the bulkheads 32 such that the outer peripheries 40 of the bases of the flights 38 overlap, thereby providing close spacing between the screws 36 within the module 16. When used herein, the term "overlap" means that the outer periphery 40 of a screw 36 is closer to the axis of rotation of the adjacent screw than it is to the screw on which the flight is mounted. Details of the screw shape and mounting on the bulkheads 32 are shown in U.S. Pat. Nos. 4,938,426 and 4,951,884, the disclosures of which are incorporated herein by reference.

Figure 4:
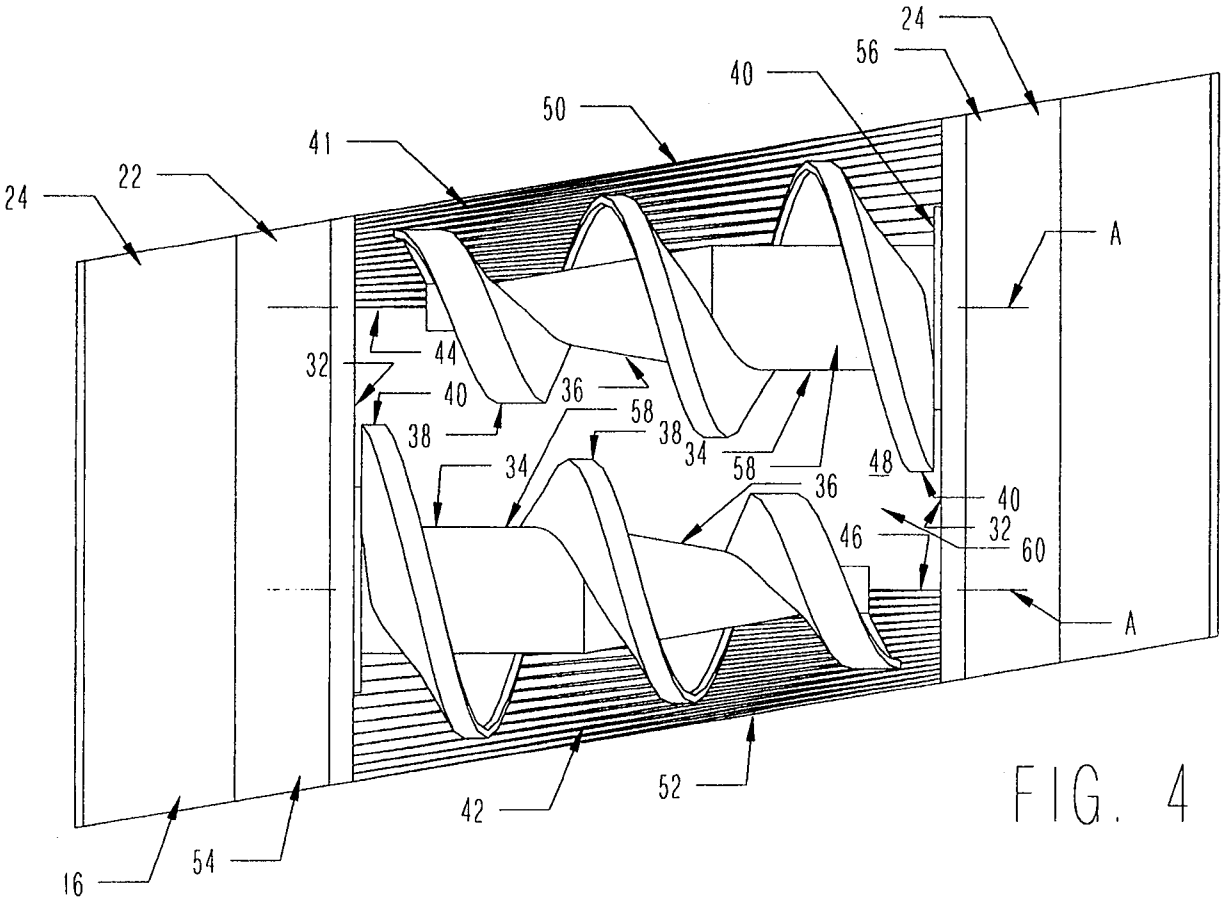
FIG. 4 is a top plan view of a module of the system of FIG. 1.

As shown in FIGS. 2 and 4, the housing 22 of the modules 16, 18 each include side deflectors 41, 42 which extend between the end enclosures 24 of each module. The side deflectors 41, 42 are conical in shape and conform to the contour of the outer periphery of the tapered flight 38 of the screw 36. The inner edges 44, 46 of the side deflectors 41, 42, respectively, extend below the screws 36 and define between them bottom openings 48 of the modules 16, 18.

In the preferred embodiment shown in FIGS. 1–4, the inner edges 44, 46 are positioned vertically directly below a rotational centerline A of each screw 36. The upper edges 50, 52 of the side deflectors 41, 42 are in a plane common with the side faces 54, 56 of the end enclosures 24 and terminate at a point below the shafts 58 of the screws 36 in the preferred embodiment. However, it is within the scope of the present invention to extend the upper edges 50, 52 above the shafts 58, but not above the upper peripheries of the flights 38, for to do so would promote the bridging of material across the modules 16, 18. It is also within the scope of the invention to provide a door or doors between the inner edges 44, 46, so that the retention time of the material within the modules 16, 18 may be varied selectively.

Consequently, each module defines a grinding chamber 60 which is bounded by the bulkheads 32 on the ends and the side deflectors 41, 42 on the sides. Further, as best shown in FIG. 1, the tops 62 of the modules 16, 18 are open and act as a material inlet to the grinding chamber 60. It is also preferable to provide diffusion cones (not shown in the figures, but disclosed in the aforementioned U.S. Pat. No. 4,938,426) as well as to provide the outer peripheries of the flights 38 with radially projecting teeth, and to provide the side deflectors 41, 42 with stationary breaker bars which are spaced and sized to mesh with the teeth.

As shown in FIG. 4, the housing 22 is rhomboid in shape; that is, the bulkheads 32 are parallel to each other and the upper edges 50, 52 of the side deflectors 41, 42 are parallel to each other, but the upper edges and bulkheads meet at non-perpendicular angles. When the modules 16, 18 are assembled as shown in FIG. 1, this enables the screw 36 of module 16 which is adjacent to module 18, to overlap the screw 36 of module 18 which is adjacent to module 16. Consequently, the overlapping spacing between screws 36 of the array of module 16, 18 is uniform.

As shown in FIG. 2, side face 56 of module 16 is attached, preferably by bolting, to side wall 64 and side face 54 of module 18 is likewise attached to side wall 66. Consequently, the array of modules 16, 18 and side wall 64, 66 define a unitary grinding area which is comprised of grinding chambers 60 of modules 16, 18.

The side walls 64, 66 are wedge shaped and are sized to form a rectangle with the array when mounted on the ends of modules 16, 18, so that the system 10 is rectangular in shape and conforms to the inlet opening 67 of the conveyor 14.

As shown in FIGS. 1 and 2, the hopper 20 is comprised of end enclosure extensions 68, which are wedge shaped and mounted on the upper surfaces of the end enclosures 24, and side wall extensions 70, which are also wedge shaped and are mounted on the upper faces of the side walls 64, 66. The extensions 68 are identical in size and shape and each includes an angled interface 72 which directs incoming material into the grinding chambers 60 of the module 16, 18. Similarly, side wall extensions 70 each include angled interfaces 74, 76 which deflect material through the open top 62 and into the grinding chamber 60 of the modules 16, 18. Further, extensions 70 include connecting faces 78, 80 which are shaped to abut the corresponding connecting faces 82 of the end enclosures extensions 68.

Figure 3:
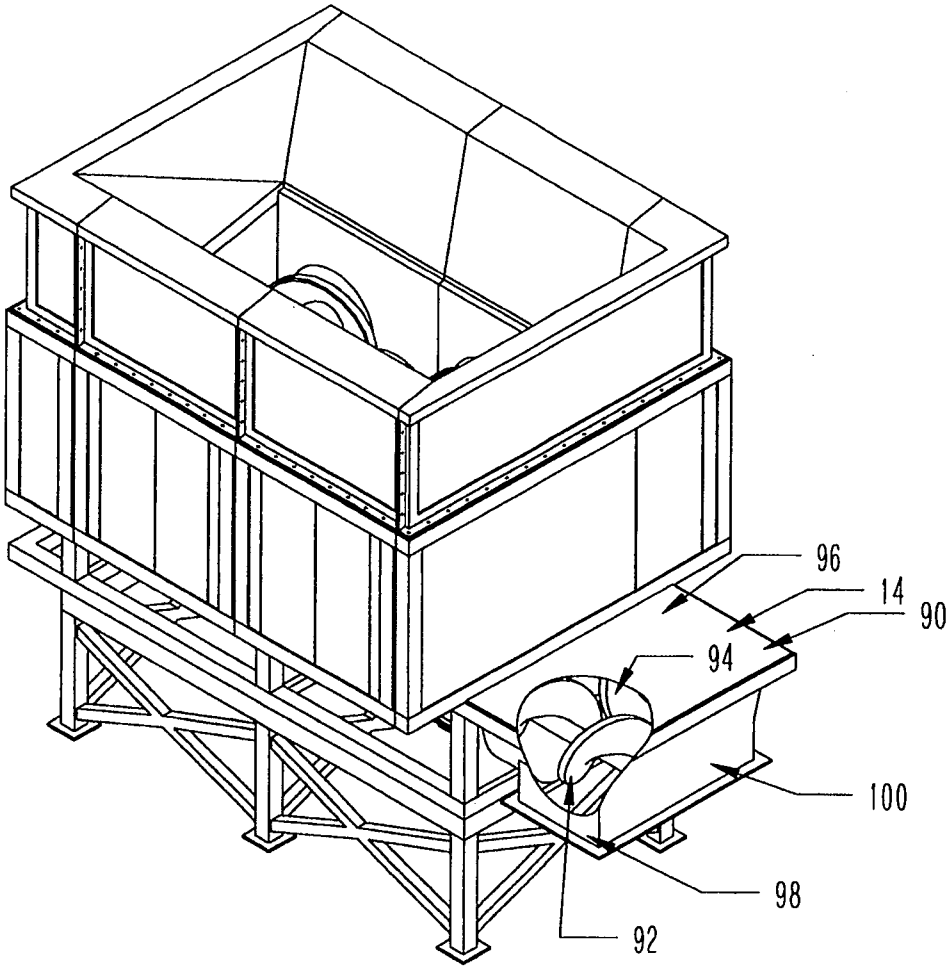
FIG. 3 is a rear perspective view of the system shown in FIG. 1.

As shown in FIGS. 2 and 3, the hopper 14 includes cylindrical, opposing side walls 84, 86, end bulkhead 88, and a discharge portion 90. A pair of counter rotating conveyor screws 92, 94 are mounted rotatably within the conveyor 14 and are powered by twin hydraulic motors 96, 98, respectively, mounted on the end wall 88.

The discharge portion 90, best shown in FIG. 3, includes a top wall 96, a planar side wall 98 and a planar end wall 100. The bottom of the discharge portion 90 is open so that material conveyed to the discharge portion by screws 92, 94 drops downwardly to a second conveyor or receptacle (not shown). While the figures show a pair of screws 92, 94 mounted within the conveyor 14, it is within the scope of the invention to provide other mechanisms for conveying, such as an endless belt conveyor made of steel or rubber, walking flooring, or the like, without departing from the scope of the invention. Further, it may be desirable to provide the screws 92, 94 with radially projecting teeth, and provide the cylindrical side walls 84, 86 with breaker bars which are shaped and positioned to mesh with the teeth in a manner similar to that disclosed in the aforementioned U.S. Pat. No. 4,938,426.

Figure 5:
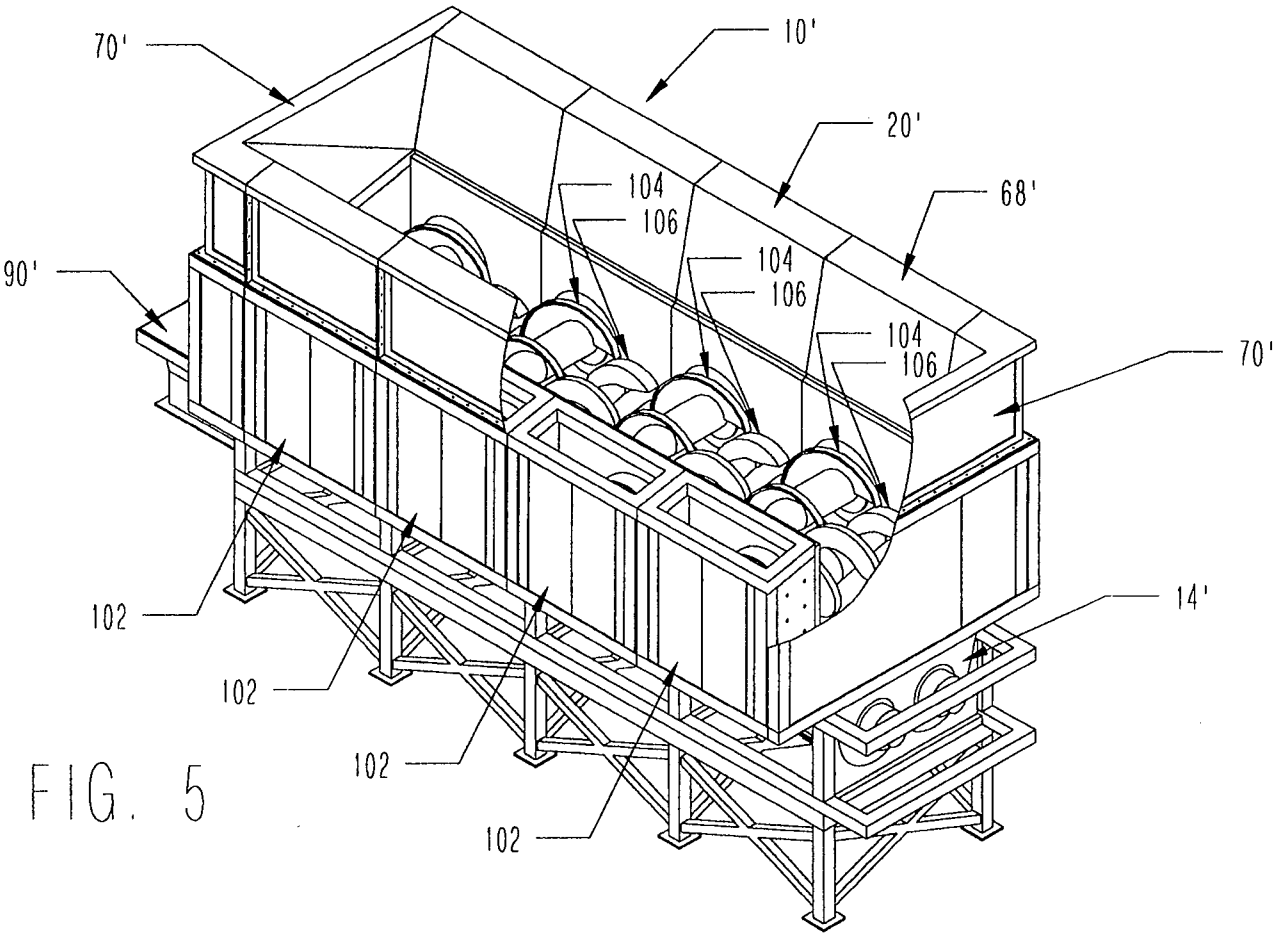
FIG. 5 is a perspective view of an alternate embodiment of the invention, showing four modules in an array.

A second embodiment of the invention is shown in FIG. 5 in which a modular system, generally designated 10', is shown which is comprised of four modules 102, placed in side-by-side relation to form an array. Each of the modules 102 is identical to modules 16, 18 in structure (see FIGS. 1–4), and each includes a pair of horizontally opposed screws 104, 106. As a result of the rhomboid shape of the modules 102 in plan view (similar to that shown in FIG. 4) the spacing between the screws 104, 106 is substantially constant across the array of modules 102. The hopper 20' is comprised of a series of end enclosure extensions 68 combined with side wall extensions 70'. The conveyor 14' has been modified to extend along the entire length of the array so that material entering the hopper 20' and shredded by the screws 104, 106 is conveyed to the discharge portion 90' for further handling.

In conclusion, the system 10, 10' shown in the figures may be comprised of one or more modules 16, 18, 102 which are identical in construction to each other and have a rhomboid shape so that the closed spacing of the twin tapered screws each houses is maintained uniformly across an array of modules. The modules and hopper components are attached to each other by bolting to form a rigid, unitary structure.

Fabrication of the system 10, 10' is facilitated in that an inventory of modules and hopper components may be maintained and a system may be constructed from any number of such modules to provide an array of a desired size and capacity.

While the forms of apparatus herein described constitute preferred embodiments of this invention, it is to be understood that the invention is not limited to these precise forms of apparatus, and that changes may be made therein without departing from the scope of the invention.

What is claimed is:

1. A modular auger shredder system comprising:

a plurality of shredder modules arranged in side-by-side relation, each of said modules including a housing having a substantially open top for receiving material to be shredded, opposing end enclosures defining a grinding chamber, auger screw means rotatably mounted on said housing within said grinding chamber for shredding said material, motor means mounted within said end enclosures for driving said auger screw means, and side deflector means for guiding said material to be contacted by said auger screw means, said side deflector means extending between said end enclosures on opposite sides of said auger screw means and terminating below an upper periphery of said auger screw means, said auger screw means including a pair of opposed auger screws having outer peripheries which overlap, and said housing being shaped such that a plurality of said modules can be positioned in side-by-side relation to form an array of said modules wherein auger screws in adjoining modules of said array overlap; and side wall means, extending between said end enclosures of end ones of said housings of said array on outboard sides of said end housings, for enclosing said grinding chambers of said outside modules;

whereby said array can receive, hold and process large volumes of waste materials at relatively rapid rates, and material entering said open tops of said housings is shredded and ground by said auger screw means of said modules of said array, said material is held against said auger screw means by said side deflector means and said side deflector means minimize bridging and jamming of said material between adjacent ones of said modules.

2. The system of claim 1 wherein said side deflector means of adjacent modules of said array abut each other and are shaped, when abutting, to deflect said material sidewardly into contact with said auger screws and minimize said material bridging over said auger screw means.

3. The system of claim 2 wherein said side deflector means are shaped to follow a contour of an adjacent portion of said auger screw means.

4. The system of claim 3 wherein said side deflector means have a conical contour.

5. The system of claim 4 wherein each of said side deflector means extends downwardly to a point substantially directly below a centerline of an associated one of said auger screw means.

6. The system of claim 1 further comprising conveyor means, positioned below said array, for transporting said material processed through said array to a collection point.

7. A modular auger shredder system comprising:

a plurality of shredder modules arranged in side-by-side relation, each of said modules including a housing having a substantially open top for receiving material to be shredded, opposing end enclosures defining a grinding chamber, auger screw means rotatably mounted on said housing within said grinding chamber for shredding said material, motor means mounted within said end enclosures for driving said auger screw means, and side deflector means for guiding said material to be contacted by said auger screw means, said side deflector means extending between said end enclosures on opposite sides of said auger screw means and terminating below an upper periphery of said auger screw means, and said housing being shaped such that a plurality of said modules can be positioned in side-by-side relation to form an array of said modules;

side wall means, extending between said end enclosures of end ones of said housings of said array on outboard sides of said end housings, for enclosing said grinding chambers of said outside modules;

conveyor means, positioned below said array, for transporting said material processed through said array to a collection point, said conveyor means including a conveyor housing for supporting said array, said housing having an open top positioned below said array and a discharge opening, and conveyor screw means positioned within said housing for transporting said material to said discharge opening;

whereby said array can receive, hold and process large volumes of waste materials at relatively rapid rates, and material entering said open tops of said housings is shredded and ground by said auger screw means of said modules of said array, said material is held against said auger screw means by said side deflector means and said side deflector means minimize bridging and jamming of said material between adjacent ones of said modules.

8. The system of claim 7 wherein said conveyor screw means includes a pair of counter-rotating conveyor screws extending through said conveyor housing.

9. The system of claim 1 further comprising hopper means, extending upwardly from said array, for guiding material into said grinding chambers of said array.

10. The system of claim 1 wherein at least one of said modules includes auger screw means having a pair of opposed, counter-rotating tapered screws, each of said screws being mounted on a different one of said end housings.

11. A modular auger shredder system comprising:

a plurality of shredder modules arranged in side-by-side relation, each of said modules including a housing having a substantially open top for receiving material to be shredded, opposing end enclosures defining a grinding chamber, auger screw means rotatably mounted on said housing within said grinding chamber for shredding said material, motor means mounted within said end enclosures for driving said auger screw means, and side deflector means for guiding said material to be contacted by said auger screw means, said side deflector means extending between said end enclosures on opposite sides of said auger screw means and terminating below an upper periphery of said auger screw means, said auger screw means including a pair of opposed, counter-rotating tapered screws having outer peripheries which overlap, each of said pair of screws being mounted on a different one of said end housings, and said housing being rhomboid in shape when viewed from above such that a plurality of said modules can be positioned in side-by-side relation to form an array of said modules, wherein said screws in adjoining modules overlap and uniform spacing between said screws is maintained across said array;

side wall means, extending between end enclosures of end ones of said housings of said array on outboard sides of said end housings, for enclosing said grinding chambers of said outside modules;

whereby said array can receive, hold and process large volumes of waste materials at relatively rapid rates, and material entering said open tops of said housings is shredded and ground by said auger screw means of said modules of said array, said material is held against said auger screw means by said side deflector means and said side deflector means minimize bridging and jamming of said material between adjacent ones of said modules.

12. The system of claim 11 further comprising a plurality of said at least one modules, attached in side-by-side relation, whereby spacing between said screws between said plurality of said at least one modules is substantially equal to a spacing between said screws of said at least one module.

13. An auger shredder module comprising:

a housing having a substantially open top for receiving material to be shredded, opposing end enclosures and side deflector means extending between said end enclosures, said end enclosures and said side deflector means defining a grinding chamber;

auger screw means rotatably mounted on said housing within said grinding chamber for shredding said material;

motor means mounted within said end enclosures for driving said auger screw means;

said side deflector means being shaped to guide said material to said auger screw means and having upper edges that terminate below said auger screw means; and said housing being shaped such that a plurality of said modules can be positioned in side-by-side relation to form an array of said modules such that said material can be dumped into said open tops of said housing of said array and shredded by said auger screw means thereof with said side deflector means preventing bridging and jamming between adjacent housings.

14. The auger shredder module of claim 13 further comprising side wall means, extending between said end enclosures, for enclosing said grinding chambers of said outside modules.

15. An auger shredder module comprising:

a housing having a substantially open top for receiving material to be shredded, opposing end enclosures and side deflector means extending between said end enclosures, said end enclosures and said side deflector means defining a grinding chamber;

auger screw means rotatable mounted on said housing within said grinding chamber for shredding said material;

motor means mounted within said end enclosures for driving said auger screw means;

said side deflector means being shaped to guide said material to said auger screw means and having upper edges that terminate below said auger screw means; and said housing being shaped such that a plurality of said modules can be positioned in side-by-side relation to form an array of said modules such that said material can be dumped into said open tops of said housing of said array and shredded by said auger screw means thereof with said side deflector means preventing bridging and jamming between adjacent housings;

side wall means, extending between said end enclosures, for enclosing said grinding chambers of said outside modules;

said housing being rhomboid in shape when viewed from above; whereby adjacent ones of said screw means overlap when a plurality of said modules are arranged in a continuous array.

16. An auger shredder module comprising:

a housing having a substantially open top for receiving material to be shredded, opposing end enclosures and side deflector means extending between said end enclosures, said end enclosures and said side deflector means defining a grinding chamber;

auger screw means rotatably mounted on said housing within said grinding chamber, said auger screw means including a pair of opposed, counter-rotating tapered screws, each of said screws being mounted on a different one of said end enclosures;

motor means mounted within said end enclosures for driving said auger screw means;

said side deflector means being shaped to guide said material to said auger screw means; and said housing being substantially rhomboid in shape when viewed from above, whereby a plurality of said modules can be positioned in side-by-side relation to form an array of said modules such that adjacent ones of said screws of adjacent ones of said modules overlap and substantially uniform spacing between said screws is maintained across said array.

* * * * *